US005904126A

United States Patent [19]

McKay et al.

[11] Patent Number: 5,904,126

[45] Date of Patent: May 18, 1999

[54] PUMP CONTROL SYSTEM

[75] Inventors: Michael Leonard McKay, Kardinya; David Shawcross, Heathridge; Craig Bowman, West Perth; Thomas Schnepple, Wembley Downs, all of Australia

[73] Assignee: Orbital Engine Company (Australia) Pty Limited, Balcatta, Australia

[21] Appl. No.: 08/714,085

[22] PCT Filed: Mar. 29, 1995

[86] PCT No.: PCT/AU95/00179

§ 371 Date: Sep. 27, 1996

§ 102(e) Date: Sep. 27, 1996

[87] PCT Pub. No.: WO95/26461

PCT Pub. Date: Oct. 5, 1995

[30] Foreign Application Priority Data

Mar. 29, 1994 [AU] Australia ..... PM 4767

[51] Int. Cl.[6] ..... F04B 49/06; F01M 1/16

[52] U.S. Cl. ..... 123/196 S; 417/43

[58] Field of Search ..... 123/196 R, 196 S, 123/73 AD; 417/43, 44.1

[56] References Cited

U.S. PATENT DOCUMENTS

| | | | |
|---|---|---|---|
| 3,511,579 | 5/1970 | Gray et al. | 417/6 |
| 4,445,470 | 5/1984 | Chmielewski | 123/73 AD |
| 4,638,771 | 1/1987 | Mori | 123/73 AD |
| 4,726,330 | 2/1988 | Shiga | 123/73 AD |
| 4,913,108 | 4/1990 | Sougawa et al. | 123/196 S |
| 5,315,971 | 5/1994 | Yamada | 123/73 AD |
| 5,390,635 | 2/1995 | Kidera et al. | 123/73 AD |
| 5,511,524 | 4/1996 | Kidera et al. | 123/73 AD |
| 5,526,783 | 6/1996 | Ito et al. | 123/73 AD |
| 5,630,383 | 5/1997 | Kidera et al. | 123/73 AD |

FOREIGN PATENT DOCUMENTS

| | | |
|---|---|---|
| B-50126/79 | 3/1980 | Australia . |
| A-46813/85 | 5/1986 | Australia . |
| 0 281 294 | 9/1988 | European Pat. Off. . |

OTHER PUBLICATIONS

JP 2–191807 Abstract Jul. 27, 1990.
JP 56–138473 Abstract Oct. 29, 1981.
JP 62–20610 Abstract Jan. 29, 1987.
WO 84/02377 Published Jun. 21, 1994.

*Primary Examiner*—Erick R. Solis
*Attorney, Agent, or Firm*—Nikaido, Marmelstein, Murray & Oram LLP

[57] ABSTRACT

A control system and method for controlling a pump having a fluid passage therein, including a sensing means for sensing fluid flow through the fluid passage wherein the control system controls the actuation period of the pump as a function of a characteristic of the fluid flow sensed by the sensing means. The sensed characteristic is the quantum rate of fluid flow through the fluid passage.

42 Claims, 4 Drawing Sheets

PUMP CONTROL SYSTEM

BACKGROUND OF THE INVENTION

This invention relates to pumps for pumping fluids and in particular liquids and control systems for such pumps. The invention will be described in relation to a lubrication system for an internal combustion engine, although it is to be appreciated that other applications are also envisaged.

It is important in lubrication systems of internal combustion engines that oil is delivered at appropriate rates to the various moving surfaces and components of the engine. This is especially important for crankcase scavenged two stroke internal combustion engines. In such engines, oil is consumed during the operation of the engine and is typically not completely recirculated as in conventional four stroke engines. Therefore, the rates of oil delivery must be carefully controlled to ensure minimal resultant exhaust gas emissions, prevent contamination of any catalytic device of the engine due to excess oil in the exhaust gases and to extend the period between oil refills.

Generally, the required rate of oil delivery varies widely depending on the engine, the load and speed operating point of the engine, the previous operating history of the engine and various other operating conditions. For example, for some two stroke cycle engines, the fuel/oil ratios can typically vary between 400:1 in low load and idle conditions, and 80:1 in sustained high load conditions. These conditions are typically determined by various sensors and a control system may control the rate of oil delivery from the pump. The control system may be external from or integral with the pump itself.

The rate of oil delivery from the pump can however also be affected by factors such as the viscosity of the oil and the voltage provided by the battery supplying power for the operation of the pump. Higher than normal oil viscosities and below normal battery voltages can result in lower than expected oil delivery rates from the pump. Other factors which would typically affect the oil delivery rate include blockages within the oil supply and/or delivery lines, air trapped within the oil system, or depletion of the oil supply. Furthermore, the transient changes to the engine operating conditions such as going from a long period of operation at a low load and speed to a higher load and speed operating point may affect the oiling rate in that a delayed increase in oiling rate may be desirable to account for any oil which may have accumulated in the engine during the previous period of operation. It has not however previously been possible to conveniently control the pump such that the above noted factors can be taken into account to ensure correct and consistent oil or fluid delivery rates.

It is an object of the present invention to provide a pump control system which takes into account at least one of the above factors.

SUMMARY OF THE INVENTION

With this in mind, the present invention provides in one aspect a control system for controlling a pump having a fluid passage therein, including a sensing means for sensing fluid flow through the fluid passage, wherein the control system controls the actuation period of the pump as a function of a characteristic of the fluid flow sensed by the sensing means.

According to another aspect of the present invention, there is provided a method for controlling a pump having a fluid passage therein and a sensing means for sensing fluid flow through the fluid passage, the method including controlling an actuation period of the pump as a function of a characteristic of the fluid flow sensed by the sensing means.

The characteristic of the fluid flow sensed by the sensing means is conveniently dependent on at least one of the above noted factors, and sensing of that characteristic therefore takes such factor(s) into account. The sensed characteristic may conveniently be the quantum rate of fluid flow through the fluid passage.

The pump conveniently pumps fluid during actuation of the pump with the fluid flow through the fluid passage occurring during said actuation. The actuation period of the pump conveniently increases when the quantum fluid flow rate decreases, and decreases when the quantum fluid flow rate increases. Alternatively, the actuation period may be fixed to a predetermined setting.

The sensing means may include a displacement sensor for sensing the displacement of a flow responsive member located within the fluid passage. The flow responsive member is conveniently displaced in response to fluid flow through the fluid passage, the displacement of the flow responsive member being dependent on the quantum fluid flow rate and/or the quantum amount of fluid ie: the volume. The displacement of the flow responsive member conveniently increases with an increasing quantum fluid flow rate and decreases with a decreasing quantum fluid flow rate and/or quantum amount. The sensing means may however include a different type of sensor means such as a mass flow sensor.

The fluid passage may be an inlet passage to the pump such that the sensing means senses fluid flow into the pump. Alternatively, the fluid passage may be an outlet passage of the pump. Where there is more than one outlet passage, a sensing means may be provided for at least one of the outlet passages or for each outlet passage. Similarly, where there is more than one inlet passage, a sensing means may be provided for at least one of the inlet passages or for each inlet passage. In this regard, the pump may be configured to pump a number of different fluids and such separate inlet passages may be desired to enable the supply of different fluids to a number of individual fluid delivery lines.

A flow control valve having a valve member associated therewith may be provided to control fluid flow through the fluid passage. The flow responsive member may be movable together with the valve member of the flow control valve. Alternatively, the flow responsive member may be formed integral with or may provide the valve member for the flow control valve. The flow control valve is conveniently an inlet relief valve of the pump. Alternatively, the flow control valve may be an outlet relief valve.

The control system can provide a feedback signal when displacement of the flow responsive member is sensed by the displacement sensor. It is preferred that the feedback signal is only provided when the displacement of the flow responsive member is above a predetermined threshold value. This prevents or minimises the possibility of erroneous feedback signals due, for example, to vibrational displacement of the flow responsive member or an insufficient fluid flow rate. Hence, selection of the threshold value determines the sensitivity of the displacement sensor. The threshold value may be set on the basis of the portion of fluid already delivered by the pump. For example, the threshold value may indicate that about half of the fluid delivery capacity of the pump has been delivered.

The actuation period of the pump may preferably be controlled by the attainment of the threshold value at which point the feedback signal is provided. The control system preferably measures a time delay between the start of the actuation period and the start of the subsequent feedback signal.

This measured time delay is termed the "sensor delay time" or "SDT". It has been determined experimentally that the control system of the pump may conveniently be configured so that the pump is actuated over at least substantially equivalent to twice the SDT to ensure full delivery of the fluid being pumped. However, the pump may alternatively be actuated over a period at least substantially equivalent to other multiples of the SDT. Alternatively, the control system may determine the actuation period of the pump as a function of the feedback signal. For example, the duration of a previous feedback signal may be used to determine the actuation period of the pump for a subsequent fluid delivery. Alternatively, the period between the end of the previous feedback signal and the detection of the subsequent feedback signal may be used to determine the pumping period of the pump.

When the fluid viscosity is high, the pump typically needs to be actuated for a longer period to ensure correct fluid delivery. However, the flow responsive member will take longer to move in excess of the threshold value resulting in a longer SDT. The control system therefore ensures that the pump is actuated for a longer period than would have been the case for a lower fluid viscosity. Similarly, when the voltage of the power supply to the pump is lower than normal, a longer actuation period is also required for correct fluid delivery as the pump will have less "pumping force" available. Because this also leads to slower movement of the flow responsive member resulting in a longer SDT, a longer actuation period is ensured.

In the situation where there is a blockage of the line providing fluid to the fluid passage or depletion of the fluid supply resulting in no net quantum fluid flow rate, the control system will not provide a feedback signal. This is similarly the case where there is a blockage of a line delivering fluid to a desired location which may result in the hydraulic lock of the pump. The control system may therefore include a timer arrangement setting a minimum and maximum period of pump actuation. The pump may be conveniently actuated for the maximum period if no feedback signal is received. If no feedback signal is received after this maximum period of actuation then the control system may provide a fault indication or initiate an engine control strategy that reduces the possibility of engine damage as hereinafter described. The control system may also provide a fixed actuation period, for example where the SDT is abnormally short.

In a preferred arrangement, the displacement sensor is a "Hall Effect" sensor, and the flow responsive member may be a ferromagnetic body element supported within the fluid passage. Displacement of the body element produces a change in the magnetic field adjacent the sensor. The sensor conveniently converts magnetic flux density into an analogue voltage to thereby provide a voltage signal termed the "Hall Voltage", which varies depending on the relative position of the body element. The flow responsive member may be elongated and the quantum fluid flow rate and/or quantum amount through the fluid passage produces a displacement of the flow responsive member. The displacement is a result of a fluid pressure gradient across the flow responsive member. The displacement of the flow response member can be modified by varying the pressure gradient across the flow responsive member. To this end, the flow responsive member may be shaped so that the clearance between the flow responsive member and the fluid passage can be varied in the direction of movement thereof to vary the pressure gradient thereacross as the flow responsive member is displaced. This can be achieved by for example tapering or otherwise modifying the shape of the flow responsive member.

The control system preferably includes a sensor control circuit in the form of a "sample-and-hold" or "moving average circuit" which conveniently includes a comparator unit for comparing the Hall Voltage and a second voltage derived from the Hall Voltage.

It is however to be appreciated that the processing of the Hall Voltage could alternatively be digital in a sampled data system with sufficient resolution. The sensor control circuit of the control system preferably provides a feedback signal when the voltage difference between the Hall Voltage and the second voltage reaches a predetermined value. The second voltage may be a voltage measured across a capacitor within the sensor control circuit, and the capacitor voltage may be at least substantially identical to the Hall Voltage prior to pump actuation. The control system preferably provides a sample/hold arrangement wherein the capacitor voltage is used as a datum voltage during pump actuation. At or shortly after the start of the pump actuation, the capacitor may be effectively disconnected from the Hall Effect sensor by means of a switching unit, so that the capacitor voltage is not effected by the change in the Hall Voltage during pump actuation. An advantage which arises from the use of this sample/hold arrangement is that it allows for the inherent compensation for variance in magnetic field strength, Hall Effect signal amplification and build-up of mechanical tolerance of the assembly. Hence the arrangement is self-calibrating.

In a preferred arrangement, the Hall Effect sensor may also sense the magnetic flux produced by a solenoid assembly of the pump when activated. The magnetic flux of the solenoid assembly sense by the sensor may be a function of the proximity of the sensor to a coil of the solenoid assembly, the magnitude of the coil current, and/or the number of windings of the coil. The polar direction of the solenoid coil my be arranged relative to the flow responsive member so that the magnetic flux of the solenoid coil is adapted to be additive with the magnetic density due to the displacement of the flow responsive member. This arrangement results in enhanced and more reliable diagnostic information because the solenoid coil actuation is also sensed by the Hall Effect sensor.

The control system also conveniently controls the frequency of actuation of the pump as a function of operating parameters of the engine. For example, where the pump is used to pump oil for use in an internal combustion engine, the frequency of pump actuation generally increases as the engine load and/or speed increase and generally decreases as the engine load and/or and speed decrease. The control system can determine the oil delivery requirement by calculating the instantaneous oil requirements over a short period, for example every 4 milliseconds, by means of a "look-up map". In the case of two-stroke engines, the look-up map may relate a fuel/oil ratio to engine load and speed. These instantaneous oil requirements can be integrated over time until the integrated calculated amount is equal to that for one pump delivery at which point the pump can be actuated.

The control system may include dampening or filtering means to moderate the rate of change of the instantaneous oil requirement as indicated by the look-up map during acceleration transients i.e. during periods of hard accelerations.

During such periods, which may typically last for only a few seconds, the actual oil requirements of the engine may not necessarily need to be as high as that indicated by the look-up map. "Dampening" the rate of change of the instantaneous oil requirements during such acceleration transients and only allowing the oiling rate to increase to its target value at a fixed rate reduces the amount of work done on the oil in pumping it unnecessarily, and can reduce the overall oil consumption rate of the engine. This system of oil flow rate damping may have applicability to many types of oil pumping systems.

During periods when the changes in speed and load of the engine are less abrupt, the instantaneous oil requirements may be determined by the look-up map as previously described. To this end, a sophisticated control means may be provided by the control system to enable transfer between the normal "look-up map" oil requirement determination means and the filtered oil requirement determination means in response to the commencement or cessation of acceleration transients. Alternatively, the degree of "dampening" could be a function of the rate of which speed and load are changing.

The control system may also provide a fault indication or initiate a strategy to extend the driving range of a vehicle or limit the power in an internal combustion engine when there is no feedback signal within a preselected time period indicating that there is little to no fluid or oil flow through the pump. For example, the control system can simply turn on a warning light and/or warning alarm when there is no feedback signal to indicate to a driver that no oil is being delivered to the engine. Alternatively, in the case of two-stroke engines, a strategy of utilising a leaner oil/fuel ratio can be implemented to extend the driving range of the vehicle within which the engine is fitted. In another alternative, a power limiting strategy can be initiated to limit the maximum engine speed and load of the engine thereby reducing the possibility of damage to the engine. In a further alternative, the control system may be arranged to stop the engine when there is no feedback signal. The above noted strategies may also or alternatively be implemented when the oil level within an oil reservoir of the engine is detected as being critically low.

Further, the control system may also provide an automatic priming function in the case where oil priming of the engine is required on assembly of a new engine or after a service overhaul or maintenance so as to fill or refill the empty oil lines to various parts of the engine. The priming function can be manually or automatically actuated and can initially cycle the pump through a number of fast actuations to pump the air out from the oil lines. Any feedback signal may be ignored during the fast actuations. At set intervals, the pump may be cycled through a smaller number of slow pump actuations to allow the sensor to work properly and to determine whether there is any oil flow through the pump. If oil flow is detected, then the pump may cycle through a set number of actuations to fill the downstream oil lines. Otherwise, if no oil flow is detected after a set maximum number of pump actuations, the control system can shut off the pump and optionally turn on a warning light to indicate that a problem has occurred during the priming function.

Still further, this pump priming sequence or the initial part thereof, can be implemented in the case where there is no feedback signal. This would help to clear any air bubbles in the oil supply line which may be the cause of no feedback signal. Alternatively, the control system can implement a pump priming sequence independent of a feedback sign by providing a preset number of pump actuations.

The pump may preferably have a plurality of fluid discharge outlets and oil lines may extend from each of the discharge outlets to points of lubrication. The pump may be adapted to provide for the same or differing oil delivery capacities between discharge outlets. In the case where the oil delivery capacities are the same for a number of discharge outlets, it is preferred that the oil lines extending therefrom deliver the same amount of oil therethrough for any number of pump actuation cycles. In this way, respective lubrication points receive the same amount of oil at the same time after any number of pump actuation cycles and hence such respective oil lines are filled at the same rate during a priming function. Accordingly, oil lines of different lengths but delivering the same amount of oil therethrough may differ in widths and/or have side galleries and cavities provided therealong to maintain substantially similar volumes in each oil line between the pump and the point of lubrication.

In the case where the oil delivery capacities are different for a number of discharge outlets and a certain oil delivery ratio exists therebetween, it is preferred that the respective volumes of the oil lines extending therefrom correspond to the same ratio. Hence, even though the discharge outlets have different oil delivery capacities, respective lubrication points each receive an appropriate amount of oil corresponding to the above ratio at the same time after any number of pump actuation cycles. That is, such respective oil lines are filled at the same rate during a priming function. Similarly, this may be achieved by the provision of different widths and/or side galleries or cavities in the oil lines to maintain a certain oil delivery ratio therebetween. For both of the above cases, this ensures that no lubrication point is excessively oiled or left dry following an oil priming operation.

The pump may be supplied with fluid from a fluid reservoir and a fluid level switch may be provided within the fluid reservoir, the fluid level switch providing a signal to the control system when the fluid level falls below a certain level.

Heating means are conveniently provided in the fluid supply line supplying fluid to the pump to heat the fluid and thereby control the viscosity of the fluid. The heating means may be in the form of a heating trace wire or element which may be accommodated within and may extend at least partially along the fluid supply line to the pump. A heating element may alternatively or in addition be provided within each of the delivery lines from the pump. The heating element may be activated in dependence on the time delay between the start of the actuation of the pump and the subsequent sending of the feedback signal. When the time delay is in excess of a predetermined value indicating a high fluid viscosity, the heating element may be activated to thereby reduce the fluid viscosity. The heating element may preferably only be activated when the ambient air temperature is below a predetermined value. This prevents the heating elements being activated as a result of low battery voltage or a blockage in the fluid line which both result in a higher time delay.

The present invention also provides a pump managed by the above described control system.

BRIEF DESCRIPTION OF THE DRAWINGS

The invention will be more readily understood from the following description of a preferred practical arrangement of the pump control system as illustrated in the accompanying drawings wherein.

DETAILED DESCRIPTION OF THE PREFERRED EMBODIMENTS OF THE INVENTION

Figure 1:
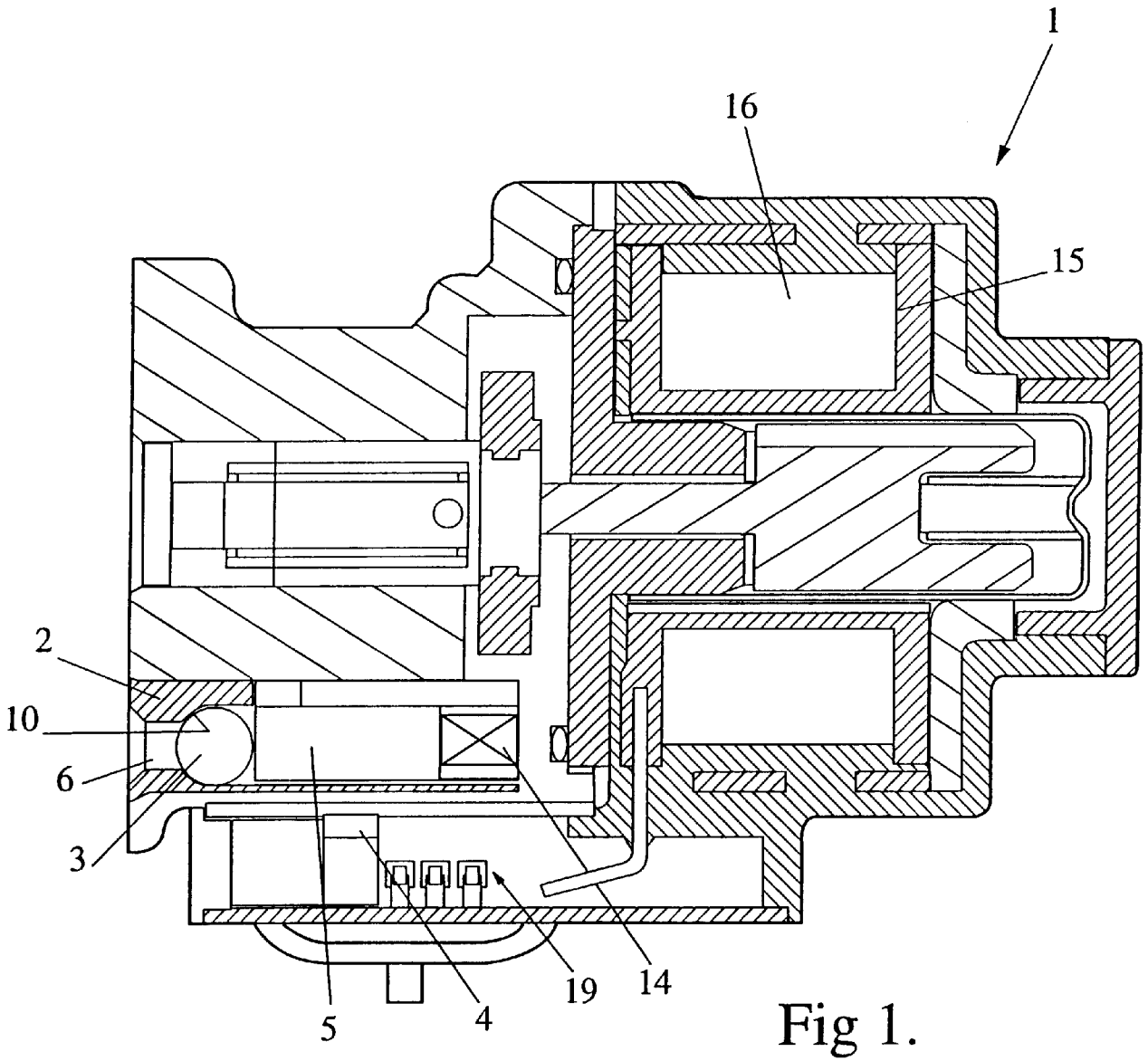
FIG. 1 is a longitudinal cross-sectional view of a pump controlled by the control system and according to the present invention.

Referring initially to FIG. 1, the illustrated pump is disclosed in the Applicant's corresponding patent application No. PM4768 by the Applicant and details of that pump are incorporated herein by reference. This pump may be used in the lubrication system of a two stroke internal combustion engine and the control system according to the present invention will be described in relation to this practical application.

The pump 1 includes an inlet relief valve 2 having a valve member 3 associated therewith which controls the flow of fluid through a fluid passage 7. Oil flow through the fluid passage 17 can be sensed by a sensing means 9. The sensing means 19 includes a Hall Effect sensor 4 mounted adjacent to the fluid passage 17. A flow responsive member in the form of an elongate body element 5 is mounted within the fluid passage 17 and abuts the valve member 3. A valve spring 14 urges the body element 5 against the valve member 3. It is also envisaged that the valve member 3 and body element 5 may be an integral component or that the body element 5 be configured to be the valve member for the relief valve 2.

The body element 5 is made of a ferromagnetic material. The Hall Effect sensor 4 senses the change in magnetic field arising due to the displacement of the body element 5 relative to the Hall Effect sensor 4. The sensor 4 converts the magnetic flux density into an analogue voltage known as the "Hall Voltage". The quantum fluid flow rate and/or quantum amount through the fluid passage 17 produces a displacement of the body element 5 in a direction of motion along its elongated axis. This displacement is as a result of the fluid pressure gradient across the valve member 3 abutting the body element 5 resulting in a force being applied on the body element 5 by the valve member 3. When the fluid flow is interrupted, the valve spring 14 and fluid backflow forces the return of the body element 5 and Valve member 3 to their initial position.

The flow is constrained by the clearance around the periphery of the valve member 3 and body element 5 and the fluid passage within which the above valve member 3 and body element 5 move. To this end, the pressure gradient across the valve member 3 and/or body element can be varied as they move in the elongated axial direction by tapering or otherwise modifying the shape of the valve member 3 and/or body element 5. This enables the displacement of the body element 5 relative to the fluid flow to be varied.

It is also envisaged that other types of sensors be used, for example, capacitance effect sensors or thermistor element sensors. Alternatively, the sensing means 19 may be provided adjacent at least one of the outlet passages or discharge check valves (not shown) of the pump 1.

Oil flowing into the relief valve 2 through its inlet 6 results in displacement of the valve member 3. This displacement is transferred to the abutting body element 5. The degree of displacement of the valve member 3 depends on the quantum oil flow rate. This displacement is greater when the quantum oil flow rate is higher and is less when the quantum oil flow rate decreases. Displacement of the body element 5 relative to the Hall Effect sensor 4 results in a change in the Hall Voltage providing an indication of changes in the position of the body element 5 and therefore also provides an indication of the quantum oil flow rate.

Figure 2:
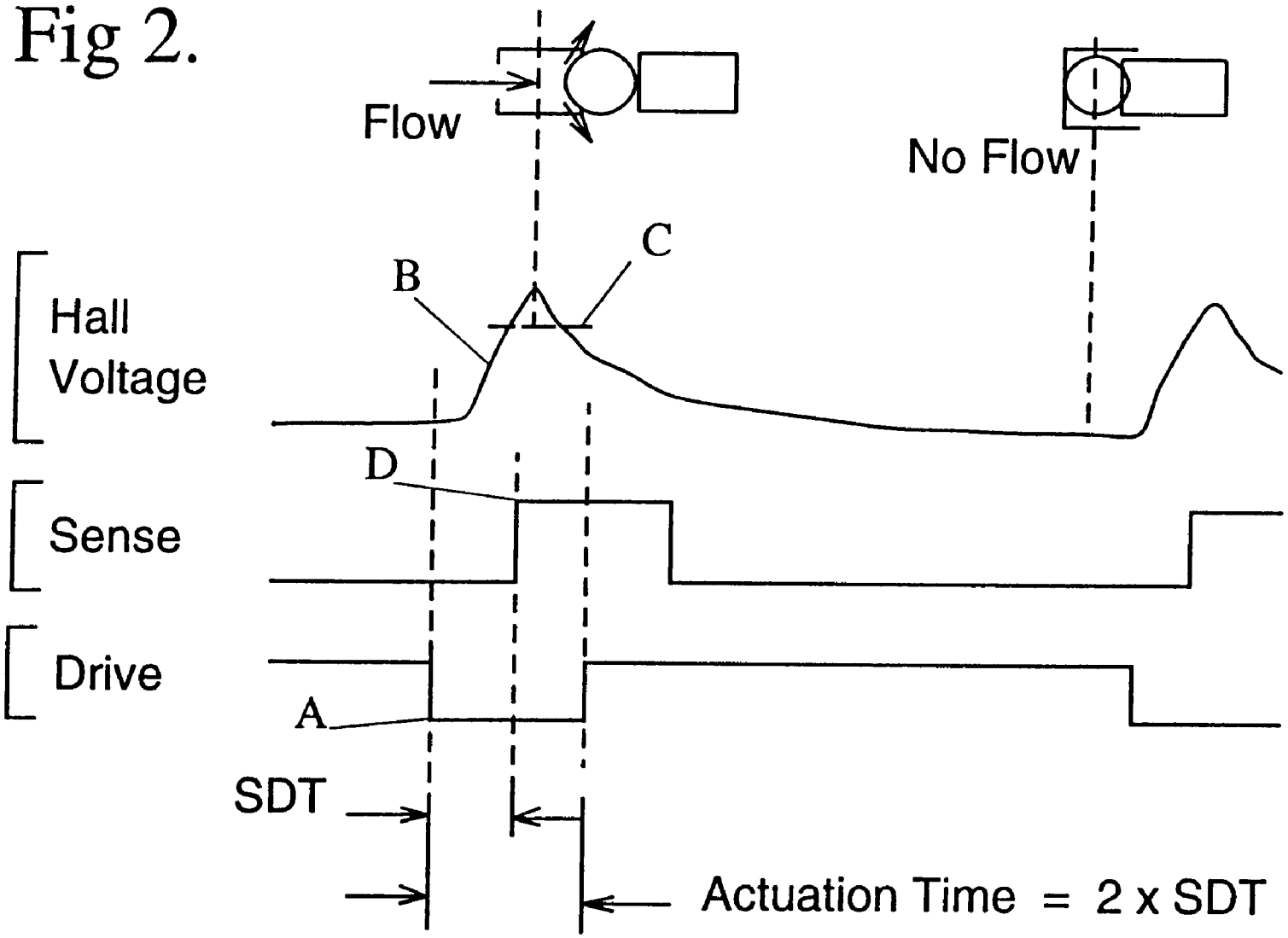
FIG. 2 is a graphical representation showing the operational relationship between the control system and the pump.

The control system utilises the Hall Voltage to provide a feedback signal which controls the period of actuation of the pump 1. FIG. 2 is a schematic graphical representation of the relationship between the Hall Voltage, the feedback signal, the oil flow through the inlet relief valve 2 and the actuation period of the pump 1, respectively designated as "Hall Voltage", "Sense" and "Drive", over a particular period of time. As the pump drive is actuated (as shown at A), the Hall Voltage begins to increase (as shown at B) due to fluid or oil flow through the relief valve 2. When the Hall Voltage reaches a predetermined threshold value (shown at C), the control system provides a feedback signal (shown at D). This feedback signal is only provided after the Hall Voltage threshold value is reached as it prevents or minimises the possibility of erroneous feedback signals due to other factors such as vibration of the pump 1 or the presence of air bubbles resulting in small displacements of the body element 5. The Hall Voltage varies as a function of the portion of the oil already delivered by the pump. The threshold value may therefore be set at a level related to a particular amount of oil delivery. For example, the threshold value may be set at the point when about half of the oil delivery capacity of the pump has been delivered. This value can be determined empirically.

The Hall Voltage threshold value provides a means of controlling the actuation period of the pump. The control system includes a timing means which measures the time delay between the start of the actuation of the pump 1 and the start of the feedback signal which is provided when the Hall Voltage reaches the threshold value. This measured time delay is termed the "sensor delay time" or "SDT". Because the threshold value is set on the basis of the portion of oil already delivered by the pump, the pump actuation period can therefore conveniently be a function of the SDT.

It has been determined experimentally that by actuating the pump over a period at least substantially equal to twice the SDT, this generally ensures full oil delivery from the pump. The control system can then be configured to actuate the pump over this period. It is however appreciated that the SDT is dependent on the setting of the Hall Voltage threshold value. The pump can therefore alternatively be actuated over a period at least substantially equivalent to other multiples of the SDT.

In an alternative arrangement, the pump actuation period can be a function of the feedback signal, with the control system determining the actuation period on the basis of the feedback signal. The actuation period may be determined from the duration of the preceding feedback signal. Alternatively, the actuation period can be determined from the duration between the end of the previous feedback signal and the detection of the subsequent feedback signal.

This control arrangement allows the control system to take into account factors such as higher than normal fluid viscosity and lower than normal battery voltage. At lower temperatures, the fluid viscosity increases and this higher fluid viscosity generally results in a lower quantum oil flow rate through the inlet relief valve 2. It is therefore necessary to actuate the pump 1 for a longer period because of the higher pumping loads on the pump 1.

A lower than normal battery voltage also results in a lower quantum oil flow rate through the inlet relief valve 2. Accordingly, a longer actuation period for the pump 1 is required because the pump 1 will have less "pumping force" available. In both of the above two situations, a longer SDT will be measured by the control system due to the longer period required for the feedback signal to be generated resulting in the required longer period of actuation of the pump 1. Hence, the higher oil viscosity or lower battery voltage conditions are suitably accounted for by the control system.

It is also possible for the control system to take into account blockages in the oil supply line to or from the pump 1 or a lack of oil flow due to depletion of the oil supply. In these situations, there would be no oil flow through the relief valve 2 resulting in no change in the Hall Voltage. The control system would not therefore provide a feedback signal indicating oil flow through the fluid passage 17. A timer arrangement can be provided in the control system to set a minimum and maximum duration for the actuation of the pump 1, typically between 60 milliseconds to 512 milliseconds. When no feedback signal is provided, for example because the oil is too cold and has an extremely high viscosity, or where the feedback signal is continuous, the pump is actuated for the maximum period. A fixed actuation period of typically 200 milliseconds may also be set when the SDT is too short, eg: less than 12 milliseconds. This fixed actuation period is cleared on receiving a valid feedback signal.

The Hall Effect Sensor 4 can simply be preset to provide a signal for the control system when the Hall Voltage reaches upper or lower threshold limits. There are, however, certain disadvantages to this control arrangement. It cannot take into account variations in the magnetic strengths of individual systems or effects arising from environmental factors such as temperature and vibration. Long term effects such as changes in the magnetic field due to the ageing of the ferromagnetic body element 5 cannot also be taken into account.

Furthermore, each system needs to be individually calibrated to properly position the body element 5 relative to the sensor 4 leading to additional costs and difficulties in the production of the pump 1.

To avoid these problems, the control arrangement can be adapted to measure voltage differences between the Hall Voltage and a second voltage derived from the Hall Voltage. The Hall Effect sensor 4 in conjunction with such a control arrangement takes into account manufacturing tolerance variation of various features such as ferromagnetic intensity, Hall Effect gain and offset, varying distances between the ferromagnetic and hall Effect elements and also overcomes the necessity of manual calibration of the control system.

Figure 3:
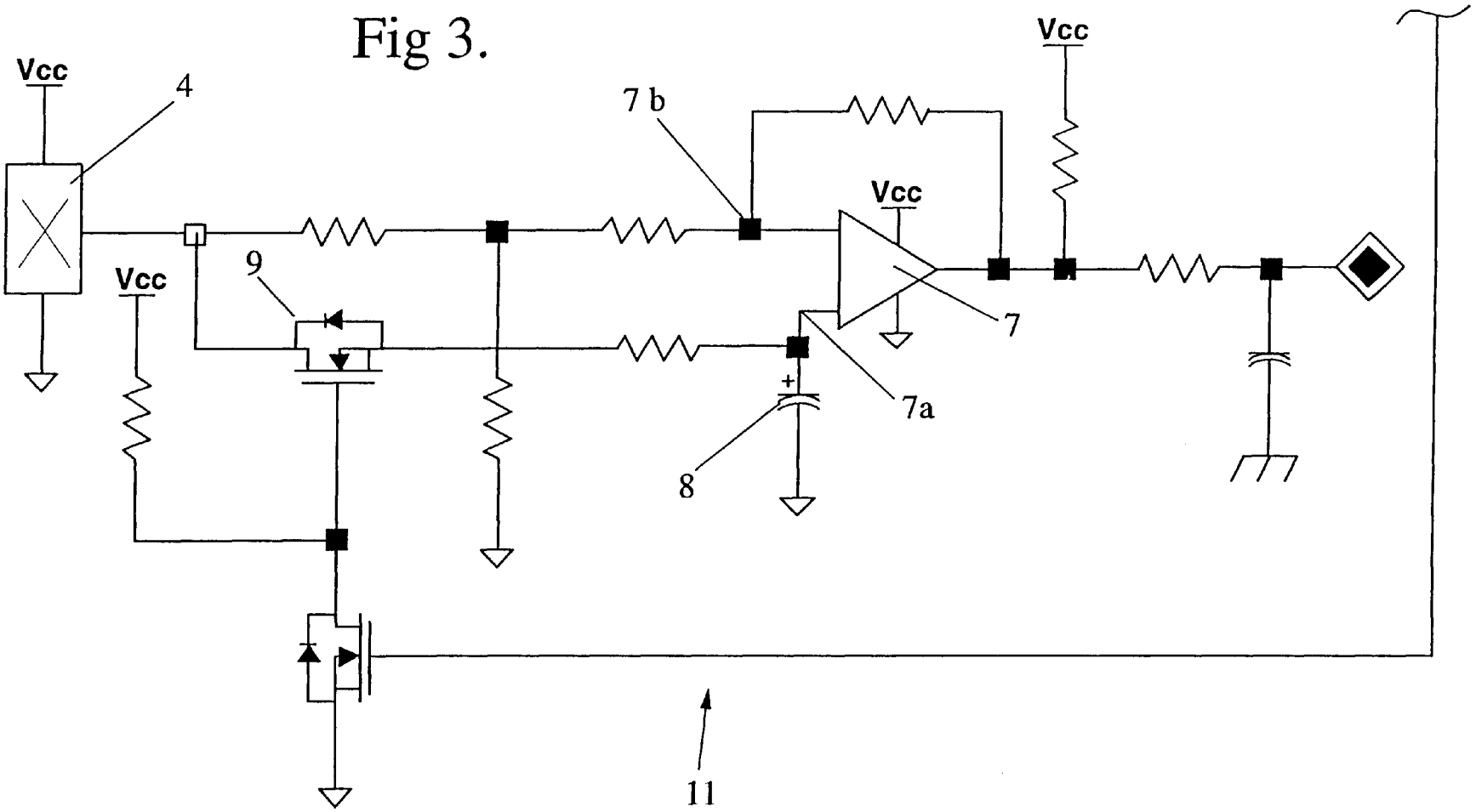
FIG. 3 is a practical arrangement of a control circuit of the control system according to the present invention.

Referring to FIG. 3, the control system includes a sensor control circuit 11 which communicates with an electronic control unit (ECU) of the engine. The Hall Voltage is measured at the positive terminal 7*b* of a comparator unit 7 and compared against the voltage across a capacitor 8, measured at the negative terminal 7*a* of the comparator 7. The sensor control circuit 11 may be formed as part of the ECU or part of the pump itself.

Prior to actuation of the pump 1, the voltage across the capacitor 8 is at least substantially equal to the "steady state" Hall Voltage which is the low voltage condition prior to oil flow through the fluid passage 17 and displacement of the body element 5. At or shortly after actuation of the pump 1, a switching unit 9, which is shown as a FET in the sensor control circuit 11 effectively disconnects the capacitor 8 from the Hall Effect Sensor 4, such that the capacitor voltage is held at the "steady state" Hall Voltage. The comparator unit 7 subsequently compares the actual Hall Voltage and the capacitor voltage.

When the voltage difference between the Hall Voltage and the capacitor voltage reaches a certain predetermined value, the control system provides the required feedback signal. This sensor control circuit 11 provides therefore a sample/hold arrangement wherein the capacitor voltage is used as a "floating" datum voltage which is held steady at the start of the pump actuation. This floating datum voltage ensures that system variations such as those previously referred to and environmental factors are taken into account. Furthermore, the measured voltage difference is independent of the actual position of the body element 5 relative to the sensor 4, thereby eliminating the need to calibrate the sensor arrangement. For example, as the frequency of the pump actuation increases, there is less time for the valve member 3 and body element 5 to return to and abut the valve seat 10 of the relief valve 2. This results in a gradual shift of the mean position of the body element 5 away from the valve seat 10. This shift will however not effect the operation of the above noted control arrangement.

It is also possible to eliminate the switching unit 9 of the sensor control circuit 11. Because of the inherent delay in the change in the capacitor voltage, a voltage difference can still be measured between the actual Hall Voltage and the capacitor voltage. However, because there will still be a slow change in the capacitor voltage, the difference will be less than provided by the above circuit leading to a potentially poorer signal/noise ratio. Nonetheless, this may be more than satisfactory for reduced specification and/or lower cost systems.

A side benefit of having such a sensor control circuit 11 is that it provides a means of checking for the presence of the pump 1, and/or for checking whether the pump 1 is properly connected to the power supply and sensor control circuit 11 prior to start up of the engine. When the ECU together with the sensor control circuit 11 are first powered up immediately prior to engine start up, there is an initial charging of the capacitor 8 which causes a feedback signal to be generated when the oil pump 1 is physically present and/or properly connected to the ECU. The capacitor 8 is not however charged if the oil pump 1 is not present and/or properly connected. In this situation, no feedback signal is generated. The ECU preferably corresponds with a warning light or other warning means which could be actuated before the engine is actually started up and run if no such signal is received. This provides a check for the proper replacement and/or connection of the oil pump 1 following, for example, service maintenance.

The control system also controls the frequency of actuation of the pump 1. It is generally necessary to increase the frequency of pump actuation as the engine load and speed increases. Typically, in the case of a three cylinder two stroke engine with a pump 1 having a pumping capacity of 0.1 CC, the period between pump actuations may vary between up to 350 seconds when the engine is idling and only 0.7 seconds when the engine is at maximum load.

The above system may be further enhanced by enabling the Hall Effect sensor 4 to also sense the magnetic flux of the solenoid coil 16 during the operation of the solenoid assembly 15. There are therefore two magnetic flux component to be sensed by the Hall Effect Sensor 4, being the magnetic flux as a result of the displacement of the body element 5, and the magnetic flux as a result of the operation of the solenoid assembly 15.

The magnetic flux of the solenoid coil 16 by the Hall Effect sensor 4 is a function of the spatial proximity of the sensor 4 to the coil 16, and the magnitude of the coil current and the number of coil turns thereof. The polar direction of the magnetic flux from the coil 16 is arranged by polarity selection considerations of the current flow direction relative to the selected magnetic polarity of the body element 5 so that the component of increasing flux density from the solenoid coil 16 as the coil current is increased is additive with the increased flux density due to the displacement of the body element 5 in a direction urged by the increasing quantum flow rate and/or quantum amount. When the coil current is reduced, this results in a reduction in the flux density from the solenoid coil 16. There is also a corresponding drop in the flux density due to the reduced displacement of the body element 5 because of a corresponding drop in the flow rate.

Therefore, the above system provides a combined overall signal for processing by the control system based on both the fluid flow rate and the electrical actuation of the pump. It has been found that the magnetic flux of the solenoid coil 16 and of the displacement of the body element 5 are of the same order of magnitude. In one example the solenoid coil flux change was about 40% of the total flux change.

The above arrangement is important in achieving high quality diagnostics in both automotive and marine systems, particularly where the pump activation frequency is required to be high so as to satisfy size and cost restraints. This is because the diagnostic information is enhanced and more reliable because of the addition of the signal provided by the solenoid coil activation. This can be advantageous when the displacement of the body element 5 is somewhat sluggish due, for example, to high fluid viscosity. The signal showing that electrical activation has occurred has generally been found to provide a strong probability of reliable fluid delivery. It should however be noted that a signal from the electrical activation only is insufficient for the system to operate properly, a signal also being required as a result of the displacement of the body element 5.

The actuation frequency is a function of the required oil delivery rate which varies in dependence on the engine load and speed. Typically, the fuel/oil ratio for the engine varies between 400:1 at idling conditions to 80:1 at maximum load conditions. To ensure that the pump 1 delivers the correct amount of oil over widely changing engine operating conditions, the control system calculates the "instantaneous" oil requirements over a short period, typically every 4 milliseconds, by means of a "look-up map" relating the fuel/oil ratio to engine load and speed. These instantaneous oil requirements are integrated over time until the integrated calculated amount equals the pump capacity, being 0.1 CC, the amount of oil delivered during each pump actuation. At this point, the pump 1 is actuated.

During periods of short hard acceleration (i.e. acceleration transients), the rapid change in the engine load and speed typically results in a dramatic increase in the instantaneous oil requirement as indicated by the lookup map. However, these acceleration transients may only last a few seconds, and it is possible that there may not be sufficient time for the lubrication system of the engine to actually deliver the required oiling rate to the required areas of the engine prior to the end of that acceleration transient. Accordingly, for such short acceleration transients, it may not actually be necessary to supply the instantaneous oil requirement during the acceleration transient. In fact, it is likely that, for example, that oil re-circulated from the crankcase may provide sufficient additional oil to compensate for the higher oil requirement during such acceleration transients.

The control system therefore may provide dampening or filtering means to moderate the rate of change of the instantaneous oil requirement as indicated by the look-up map during acceleration transients. Hence, the oiling rate may only be allowed to increase to its target value at a fixed rate and still facilitate sufficient oiling of the engine and engine components. When the rate of change of the engine load and speed is less abrupt, the control system can use the look-up map as previously described to determine the instantaneous oil requirements. To this end, a sophisticated control means may be provided by the control system to enable transfer between the normal look-up map oil requirement determination means and the filtered oil requirement determination means in response to the commencement or cessation of acceleration transients. Further, the control means could be adapted to detect where a vehicle is being driven hard and repetitive hard accelerations are occurring such that it could revert to determining the oil requirements of the engine solely from the normal look-up map determination means and hence counter the hard driving of the vehicle. It is believed that moderating the rate of change of the instantaneous oil requirements during acceleration transients can lead to significant reductions in the overall oil consumption rate of the engine, for example, by around 20%.

Figure 4:
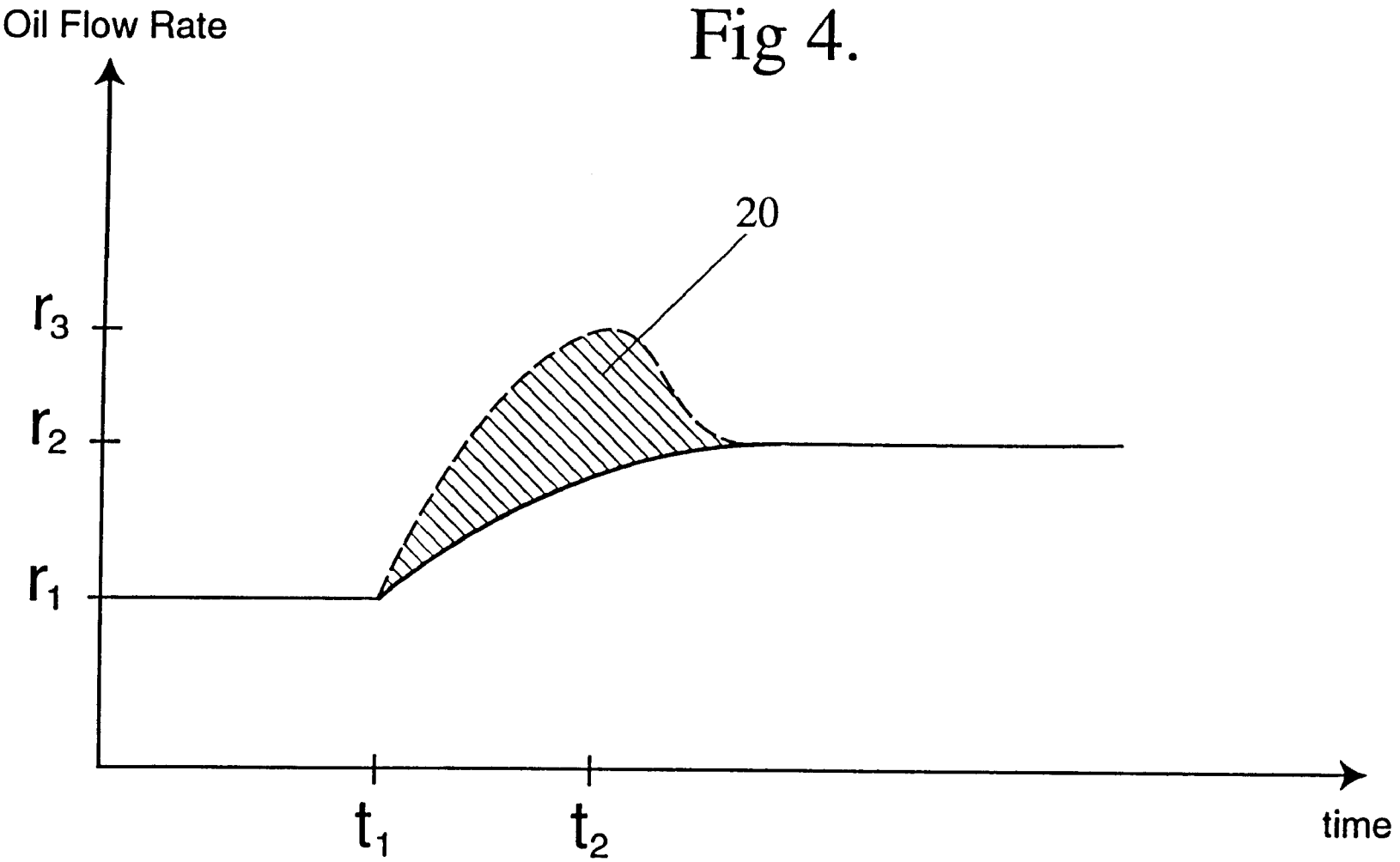
FIG. 4 is a graphical representation showing oil pumping rate as a function of time for two alternative embodiments of the present invention.

FIG. 4 shows graphically an exemplary situation in which oil flow damping is beneficial. The required oil flow rate increases from $r_1$ (ie at a first constant engine condition) to $r_2$ (ie at a second engine condition requiring a higher oil flow rate) over time $t_1$ to $t_2$. At $t_1$, engine acceleration is suddenly increased in order to raise the speed to the desired level, giving a high transient acceleration. At $t_2$, this level is reached, and acceleration is cut. From $t_1$ to $t_2$, the look-up map reads a higher target oil flow rate of $r_3$, as a result of the increased acceleration. The undamped system (depicted in the graph by the dotted line) shows a rapid rate of increase in oil flow to the target rate $r_3$. Once the acceleration is cut at $t_2$, the oil flow rate falls back to the new target rate $r_2$. In the damped system (depicted in the graph by the solid line), however, the oil flow rate rises towards $r_3$ at a much slower rate during transient acceleration, and does not reach the same level as that of the undamped system. At $t_2$, the target oil flow rate is reset to $r_2$ and the actual flow rate reaches the new target flow rate a short time later. The shaded area 20 represents the extra work done by the undamped system in raising the fuel rate to an unnecessarily high level. This extra work increases fuel consumption as discussed above.

The control system also provides a fault indication or an engine cut-out/power limiting strategy. This can be achieved by the control system keeping a history of failed pump actuations (i.e. wherein no feedback signal is received) and taking necessary action in the event that the number of failed actuations exceeds a certain preset limit. For example, the status of the last 16 pump actuations may be kept wherein any missing feedback signal is considered an error. As soon as 4 out of 16 consecutive pump actuations are recorded with a missing feedback signal, the control system can provide a fault indication, for example, a warning light or alarm, warning the driver of an oil pump flow error. Alternatively, the control system can implement a power limiting strategy wherein the maximum engine speed and load is limited to thereby reduce the possibility of damage to the engine. The control system may alternatively stop the engine.

Alternatively, the control system may schedule additional actuations to compensate for the failed pump actuations.

In an alternative engine control strategy, for certain engine operating conditions the pump is activated at a greater than normal rate to provide more oil to sensitive or critical components of the engine. This strategy may be introduced when the engine is above a certain temperature, for example over 120° C. the temperature measured can be the coolant temperature. This reduces the possibility of damage to engine components such as pistons and cylinder bores at high engine temperatures. This strategy may also be conducted in conjunction with other engine power limiting strategies, for example when the fuelling to the engine is reduced or modified to prevent the engine from running in the high temperature region.

A similar engine control strategy of activating the pump at a greater than normal rate can be conducted when the engine is running below a desirable operating temperature, for example, at cold start. The additional oil will prevent component failure at low engine temperatures, for example, piston tightening in a cold bore as the temperatures of the components increase. This strategy may also be used in conjunction with another power limiting strategy as in the previously described strategy.

A level sensor within a reservoir supplying lubrication oil to the pump 1 could also be used to provide a signal for the control system when the oil level, and therefore the amount of oil remaining in the reservoir, drops below a predetermined level. The level sensor can be a float level switch although other sensor options are also envisaged such as a thermistor element or optical reflective device. Once a low oil signal is sent by the level switch, the control system can track the remaining oil in the reservoir by counting the number of subsequent pump actuations. A warning light can also be provided to indicate to the driver that the oil level is low. The light may be adapted to flash at a progressively higher frequency as the amount of remaining oil in the reservoir continues to drop.

The control system can also provide an automatic priming function. Oil priming of an engine is required on assembly of a new engine or after a service overhaul or maintenance to fill or refill the empty oil lines. The priming function may be manually actuated to initially cycle the pump 1 through a number of fast actuations which help to push air from the oil line. If the pump 1 is actuated too slowly, air bubbles may move back towards the pump 1. At set intervals during the initial fast actuations of the pump 1, the pump 1 is operated through a number of actuations which enable the sensor 4 to work to enable it to detect any oil flow. Any feedback signals are ignored during the fast actuation of the pump 1. Once oil flow is detected, the pump 1 is then cycled through a set number of actuations to fill the downstream oil line or lines. If no oil flow is detected after a set number of actuations, then the control system can shut off the pump 1 and a warning light can optionally be lit to indicate that a problem has occurred during the priming function.

Furthermore, the priming function may be automatically initiated where there is no feedback signal from the control system. This may be because of air bubbles in the oil supply line and the priming function assists to clear the oil supply lines of these air bubbles.

The pump 1 is provided with a plurality of oil discharge outlets. Each outlet can have the same or a different oil delivery capacity. Oil lines extend from each discharge outlet to respective points of lubrication.

In the case where the oil delivery capacities are the same for a number of discharge outlets, the respective oil lines extending therefrom are arranged to deliver the same amount of oil therethrough for any number of pump actuation cycles to ensure that each point of lubrication receives the same amount of oil following the priming function, and to prevent any of the lubrication points receiving excessive oil or remaining dry. This is achieved by the respective oil lines having different widths and/or having side galleries and cavities provided therealong. This provides at least substantially similar volumes in each oil line between the pump and the point of lubrication and ensures that the respective oil lines are filled at the same rate during a priming function.

In the case where the oil delivery capacities are different for a number of discharge outlets, the volumes of the respective oil lines extending therefrom are correspondingly sized to deliver a correct amount of oil therethrough for any number of pump actuation cycles. That is, respective lubrication points each receive on appropriate amount of oil which corresponds to the ratio of oil delivery capacities of the discharge outlets. Again, this is achieved by the provision of different widths and/or side galleries or cavities in the oil lines to maintain a certain oil delivery ratio therebetween and to ensure that respective oil lines are filled at the same rate during a priming function. Hence, the provision of appropriately sized oil lines having certain overall volumes in conjunction with the differing or similar oil delivery capacities of the pump discharge outlets facilitates proper priming as described hereinbefore.

It is also possible to control the oil viscosity by means of heating elements provided in the oil supply and/or delivery lines. The heating means may for example be in the form of a heating trace wire accommodated within and extending at least partially along an oil line. The control system can for example control the operation of the heating element in dependence on the measured SDT. It is also envisaged that, where there is no feedback signal, the control system actuates the heating trace line to heat the oil and thereby reduce the viscosity thereof. Alternatively, or in addition, the control system can actuate the heating trace when the battery voltage is below normal.

Following on from the first noted example, heating elements may be configured to be activated in response to the SDT being in excess of a predetermined value which would tend to indicate a high fluid viscosity. The heating elements may also be configured to only be activated on the basis of the SDT when the ambient air temperature, as sensed by an appropriate sensor connected to the control system, is below a predetermined value. In this way, the heating elements are prevented from being activated if the battery voltage is low or if there is a true blockage in an oil delivery line, both of these conditions typically resulting in a longer SDT. It is also envisaged that the activation of the heating elements is a function of the pump actuation period or is pulse width modulated.

Nonetheless, the control system may be arranged to activate the heating elements under these latter conditions to reduce the viscosity of the fluid to a lower level making it easier to pump. Hence, if a blockage does in fact exist in a fluid delivery line, reducing the viscosity of the fluid may result in some of the fluid, for example a thinner oil, being able to be pumped around the blockage and still reach the desired delivery location. This may be particularly relevant in an engine application where the successful delivery of even a small amount of oil may be sufficient to maintain the engine in a limp home mode of operation.

We claim:

1. A control system for controlling the oil delivery rate of a positive displacement oil pump for an internal combustion engine, the pump having an oil passage located within or in fluid communication with the pump, including a sensing means for sensing oil flow through the oil passage, wherein the control system controls the actuation period of the pump as a function of a characteristic of the oil flow sensed by the sensing means.

2. A control system according to claim 1 wherein the sensed characteristic is the quantum rate of oil flow through the oil passage.

3. A control system according to claim 2 wherein the pump pumps oil during activation of the pump with the oil flowing through the oil passage during said activation.

4. A control system according to claim 2 wherein the sensing means includes a displacement sensor for sensing the displacement of a flow responsive member located within the oil passage, the displacement thereof being a function of the quantum oil flow rate.

5. A control system according to claim 4 wherein a flow control valve comprising a valve member controls oil flow through the oil passage, the flow responsive member being movable together with the valve member.

6. A control system according to claim 4 wherein a flow control valve controls oil flow through the oil passage, flow responsive member being a valve member for the flow control valve.

7. A control system according to claim 5 wherein the flow responsive member is shaped so that the clearance between the flow responsive member and the oil passage varies in the direction of movement thereof to vary the pressure gradient thereacross as the flow responsive member is displaced.

8. A control system according to claim 5 wherein the flow control valve is an inlet relief valve of the pump.

9. A control system according to claim 4 wherein the displacement sensor is a Hall Effect sensor and the flow responsive member is made from a ferromagnetic material.

10. A control system according to claim 9 wherein the pump is actuated by a solenoid assembly, and the Hall Effect sensor also sense the magnetic flux produced by a solenoid coil of the solenoid assembly when energised.

11. A control system according to claim 10 wherein the magnetic flux of the solenoid coil sensed by the Hall Effect sensor is a function of the proximity of the sensor to the coil of the solenoid coil, the magnitude of the coil current, and/or the number of windings of the coil.

12. A control system according to claim 10 wherein the polar direction of the solenoid coil is arranged relative to the magnetic polarity of the flow responsive member so that the magnetic flux of the solenoid coil is adapted to be additive with the magnetic density of the flow responsive member.

13. A control system according to claim 4 including a sensor control means having a comparator unit for comparing a Hall voltage provided by the displacement sensor and a reference voltage provided by the comparator unit as a function of the Hall voltage, wherein the sensor control means provides a feedback signal when the voltage difference between the Hall voltage and the reference voltage reaches a predetermined value.

14. A control system according to claim 13 wherein the reference voltage is at least substantially equal to the Hall voltage prior to actuation of the pump.

15. A control system according to claim 13 including a fault indication means for providing a signal when no feedback signal is received.

16. A control system according to claim 13 including means for operating an engine with a predetermined engine control strategy when no feedback signal is received.

17. A control system according to claim 1 including control means for controlling the frequency of actuations of the pump as a function of operating parameters of the engine, and damping means for moderating the rate of change of the amount of oil provided by the pump as a result of changes in the engine operating parameters.

18. A control system according to claim 1 including priming means for actuating the pump over a predetermined number of relatively fast actuations to provide a priming function for the engine.

19. A control system according to claim 18 wherein the pump is connectable to a plurality of oil lines of the engine for conveying oil to points of lubrication, with each said oil line being connectable to an outlet of the pump and being at least substantially identical in volume between the pump and the point of lubrication.

20. A control system according to claim 19 wherein the oil lines are of different widths and/or include side galleries and cavities therein.

21. A control system according to claim 19 including heating means provided in an oil supply line to the pump for controlling the viscosity of the oil being supplied to the pump.

22. A control system according to claim 1 including heating means to heat the oil within oil supply lines providing oil to the pump to thereby control the viscosity of the oil.

23. A control system according to claim 22 wherein the heating means are activated in dependence on a measured time delay.

24. A control system according to claim 22 wherein the heating means are activated in dependence on the pump activation period.

25. A method for controlling the oil delivery rate of a positive displacement oil pump for an internal combustion engine, the pump having an oil passage located within or in fluid communication with the pump, and a sensing means for sensing oil flow through the oil passage, the method including controlling an actuation period of the pump as a function of a characteristic of the oil flow sensed by the sensing means.

26. A control method according to claim 25 wherein the sensed characteristic is the quantum rate of oil flow through the fluid passage.

27. A control method according to claim 26 including increasing the pump actuation period when the quantum oil flow rate decreases, and decreasing the pump actuation period when the quantum oil flow rate increases.

28. A control method according to claim 27, including sensing the displacement of a flow responsive member provided within the oil passage with a displacement sensor, the flow responsive member being displaceable in dependence on the quantum oil flow rate through the oil passage.

29. A control method according to claim 28 including the displacement sensor providing signals to a control system in dependence on the displacement of the flow responsive member, and the control system providing a feedback signal when the displacement of the flow responsive member is above a predetermined threshold value.

30. A control method according to claim 29 including controlling the period of actuation of the pump as a function of the time delay between the start of the actuation of the pump and the subsequent sending of the feedback signal.

31. A control method according to claim 30 including actuating the pump over a period corresponding to a multiple of the time delay.

32. A control method according to claim 30 wherein the pump is actuated over a period at least substantially corresponding to twice the time delay.

33. A control method according to claim 30 including actuating the pump over a period as a function of the duration of the feedback signal.

34. A control method according to claim 33 including actuating the pump over a period corresponding at least substantially to the duration of a previous feedback signal.

35. A control method according to claim 30 including actuating the pump over a period at least substantially corresponding to the period between the end of a previous feedback signal and the detection of a subsequent feedback signal.

36. A control method according to claim 30 including actuating the pump over a predetermined period when no feedback signal is received.

37. The control method according to claim 36 including providing a fault indication signal when no feedback signal is received.

38. A control method according to claim 36 including initiating a predetermined engine control strategy for reducing the possibility of damage to the engine when no feedback signal is received.

39. A control method according to claim 3 including actuating the pump over a predetermined period when the time delay is below a minimum predetermined period.

40. A control method according to claim 25 including actuating the pump over a greater than normal rate when the temperature of the engine exceeds a predetermined value.

41. A control method according to claim 25 including activating the pump over a greater than normal rate when the temperature of the engine is below a predetermined value.

42. A control method according to claim 25 including cycling the pump through a number of relatively short periods of actuation to pump oil during a priming function for the engine.

* * * * *